US006637136B2

(12) United States Patent
Aoki et al.

(10) Patent No.: US 6,637,136 B2
(45) Date of Patent: Oct. 28, 2003

(54) BACKHOE UNIT DETACHABLY ATTACHED TO A TRACTOR

(75) Inventors: Tuyoshi Aoki, Sakai (JP); Eiji Miyazaki, Sakai (JP)

(73) Assignee: Kuboto Corporation (JP)

( * ) Notice: Subject to any disclaimer, the term of this patent is extended or adjusted under 35 U.S.C. 154(b) by 0 days.

(21) Appl. No.: 10/083,658

(22) Filed: Feb. 26, 2002

(65) Prior Publication Data

US 2003/0009920 A1 Jan. 16, 2003

(30) Foreign Application Priority Data

Jul. 10, 2001 (JP) ..... 2001-209950
Oct. 29, 2001 (JP) ..... 2001-331424
Oct. 29, 2001 (JP) ..... 2001-331426

(51) Int. Cl.[7] ..... E02F 3/04
(52) U.S. Cl. ..... 37/468; 414/686
(58) Field of Search ..... 37/468, 416, 417; 172/272–275; 414/686, 680

(56) References Cited

U.S. PATENT DOCUMENTS 3,495,727 A 2/1970 Long
3,904,051 A 9/1975 Tsuchiya et al.
4,182,456 A 1/1980 Paul
4,393,751 A 7/1983 Kelley ..... 91/408
6,056,502 A 5/2000 Takemura et al. ..... 414/686

FOREIGN PATENT DOCUMENTS

JP 10-7014 1/1998

OTHER PUBLICATIONS

Kelley Compact Backhoes B750 Series, Published by Kelley Manufacturing Corporation, date unknown, no author. Relevant pp. 1–2.

Kelley Compact Economy Backhoes B600 Series, Published by Kelley Manufacturing Corporation, date unknown, no author. Relevant pp. 1–2.

*Primary Examiner*—Christopher J. Novosad
(74) *Attorney, Agent, or Firm*—Webb Ziesenheim Logsdon Orkin & Hanson P.C.

(57) ABSTRACT

A backhoe unit detachably attached to a backhoe mounting frame disposed on a tractor body rearwardly of a driver's seat. The backhoe unit includes a base having engaging portions for connection to the backhoe mounting frame, a driver's footrest and a control column disposed on the base, a vertical swing axis supported by the base, a boom bracket supported to be swingable about the vertical swing axis, and a boom assembly attached to the boom bracket. The boom bracket is swung horizontally by a single swing cylinder having one end thereof connected to the base through a first cylinder connecting portion, and the other end connected to the boom bracket through a second cylinder connecting portion. The swing cylinder is disposed in a lateral position of the base.

18 Claims, 16 Drawing Sheets

BACKHOE UNIT DETACHABLY ATTACHED TO A TRACTOR

BACKGROUND OF THE INVENTION

1. Field of the Invention

This invention relates to a backhoe unit detachably attached to a backhoe mounting frame disposed on a tractor body rearwardly of a driver's seat.

2. Description of the Related Art

Conventionally, this type of backhoe unit is applied to a tractor known as a TLB (tractor-loader-backhoe) having a loader attached to the front of a vehicle body and the backhoe unit to the rear of the vehicle body. In such a TLB, as disclosed in Japanese Patent Laying-Open Publication H10-7014 and U.S. Pat. No. 6,056,502, a backhoe mounting frame is disposed at the rear of a tractor body, and a base that supports a backhoe unit is detachably attached to this backhoe mounting frame. The base includes a pair of right and left stabilizers and a vertical swing axis about which a boom bracket is swingable. A boom assembly is attached to the boom bracket. The boom bracket is horizontally swung by a pair of right and left swing cylinders. The right and left swing cylinders are the trunnion type distributed laterally of the center of the base, and arranged to extend parallel to each other in the fore and aft direction of the tractor body. Thus, fore and aft long spaces are required for accommodating the swing cylinders. In addition, four hydraulic hoses are needed for the two swing cylinders requiring a large accommodation space also. The entire base therefore has in a large fore and aft dimension, resulting in an increased fore and aft length of the backhoe unit. The backhoe unit when attached imposes a considerable load on the tractor body.

The base of the backhoe unit has a footrest formed thereon, and a control column of rectangular cross section is disposed in a transversely middle position in a rearward region of the footrest. In a large TLB, spaces are formed between right and left rear wheel fenders and right and left sides of the control column of the backhoe unit attached, thereby providing walkthrough spaces for the driver which extend longitudinally of the tractor body.

However, in small and medium-size TLBs, only narrow spaces are formed between the right and left rear wheel fenders and the right and left sides of the control column. The control column must be disposed further rearward from the rear wheel fenders to produce walkthrough spaces extending transversely of the tractor body. This results in an increased distance from the rear end of the tractor body to the control column of the backhoe unit attached, thereby increasing the total length of the backhoe unit, particularly the fore and aft dimension of the base. The increased fore and aft dimension of the base is detrimental to the weight balance of the TLB.

SUMMARY OF THE INVENTION

The object of this invention is, starting from a backhoe unit including a base having engaging portions for connection to the backhoe mounting frame, a driver's footrest and a control column disposed on the base, a vertical swing axis supported by the base, a boom bracket supported to be swingable about the vertical swing axis, and a boom assembly attached to the boom bracket, to overcome the disadvantages of the prior art noted above, and provide a compact backhoe unit that secures walkthrough spaces for the driver to climb up to and down from the footrest on the base with ease.

The above object is fulfilled, according to this invention, by a backhoe unit in which the boom bracket is swung horizontally by a single swing cylinder having one end thereof connected to the base through a first cylinder connecting portion, and the other end connected to the boom bracket through a second cylinder connecting portion, the swing cylinder being disposed in a lateral position of the base. With this construction, since the boom bracket of the backhoe unit is swung by a single swing cylinder, a construction relating to the swing cylinder is simplified, space may be reduced, and thus the base may have a reduced fore and aft dimension.

The swing cylinder may be placed to extend at an angle to a fore and aft direction of the tractor body. Then, the swing cylinder occupies a reduced fore and aft length, thereby reducing the fore and aft dimension of the base. This contributes toward a reduction in the load of the backhoe unit applied to the tractor body.

The swing cylinder is subjected to a heavy load. It is therefore preferable to support the swing cylinder by a strong portion of the base. As a specific measure therefor, it is proposed here that the engaging portions include a pair of right and left upper engaging portions and a lower engaging portion, the first cylinder connecting portion being disposed in a region substantially between the upper engaging portions and the lower engaging portion.

To achieve the above object, this invention proposes to limit an angle of swinging of the boom bracket by the swing cylinder to be smaller than 90 degrees. This is based on breaking of the fixed idea that the boom assembly must be horizontally swung 90 degrees right and left to transport soil, stone and the like with the bucket of the boom assembly. That is, by reducing the swing angle, a reduction is achieved in the distance between the vertical swing axis and backhoe mounting unit. It is extremely rate to swing the boom assembly 90 degrees to the right or left. There is hardly any disadvantage in performing ordinary operations if the swing angle of the boom bracket is limited to be smaller than 90 degrees. A simple form for limiting the swing angle reliably may be a pair of right and left stoppers disposed on the backhoe mounting frame for contacting the boom bracket. These stoppers may be disposed on the backhoe mounting frame.

The boom approaches the control column when the boom assembly is swung upward. In a preferred embodiment of this invention, the control column has a casing defining an opening in a lower rear portion thereof for permitting entry of an arm cylinder support of the boom assembly when the boom assembly swings upward by a maximum angle. This construction further reduces the fore and aft dimension from the control column to the vertical swing axis, and hence the fore and aft length of the backhoe unit.

As another measure for reducing the fore and aft dimension from the control column to the vertical swing axis, it is proposed that the distance from a rear surface of the casing to the vertical swing axis is smaller than a half of a maximum width of the boom assembly. The fore and aft dimension from the control column to the vertical swing axis may be reduced also where the footrest includes right and left portions located adjacent rear ends of right and left rear wheel fenders of the tractor, and a middle portion projecting forwardly of the rear ends of the right and left rear wheel fenders.

In a preferred embodiment of this invention, the engaging portions include a pair of right and left upper engaging portions and a lower engaging portion, and each of the upper engaging portions includes a pair of upper and lower mount holders vertically pivotably supported by pivotal supports to be forwardly openable and closable for approaching, from behind, an upper coupling attached to the backhoe mounting frame, and removably engaging the upper coupling from radially outward directions, and a retaining member movable, from behind, into a space between the mount holders and rearwardly of the pivotal supports for locking the mount holders against pivotal movement, the upper and lower mount holders being formed asymmetrical and the retaining member being inclined rearward and downward, thereby allowing the retaining member to extend under the footrest. This construction allows the footrest to be disposed close to the rear end of the tractor and to have an increased area.

The boom bracket may have a lower end thereof substantially level with the engaging portions. Thus, the base may be disposed in the lowest possible level to stabilize the weight balance of the backhoe unit.

To fulfill the foregoing object of this invention, it is also proposed that a walkthrough space is formed on the footrest to extend obliquely rearward from a rear position of the driver's seat.

Though a sufficient walkthrough space is formed for the driver, this construction reduces the fore and aft dimension from the rear end of the tractor body to the control column, contributing to making the base of the backhoe unit compact.

Further, the control column may have a casing with a front surface thereof smaller in width than a rear surface, and right and left sides inclined rearwardly and outwardly from the front surface. Thus, the fore and aft dimension from the rear end of the tractor body to the control column may be reduced while securing the large walkthrough space.

In one preferred embodiment of this invention, the footrest includes a pair of right and left foot supports diverging rearward for the driver's feet to be placed at opposite sides of the control column, and a passage portion extending between heel ends of the foot supports forwardly of the control column for enabling movement of the driver's feet. With this construction also, the fore and aft dimension from the rear end of the tractor body to the control column may be reduced while securing a sufficient space for the driver.

The footrest may include foot stoppers formed laterally of front edges thereof. Then, a projection of the feet from the footrest may be restricted even though the fore and aft dimension from the rear end of the tractor to the control column is reduced.

It is also advantageous to employ a construction in which the footrest is approximately channel-shaped opening rearward in plan view, the control column being trapezoidal, diverging rearward in plan view, and being disposed in a rearwardly opening portion of the footrest.

Further, the casing of the control column may house control valves for controlling the swing cylinder and the boom assembly, the control valves being operable by control levers arranged above the control valves. Then a free space is provided outside the control column, and no obstructive components are present around the driver's feet.

Other features and advantages of this invention will be apparent from the following description of the embodiment to be taken with reference to the drawings.

DESCRIPTION OF THE PREFERRED EMBODIMENT

Figure 1:
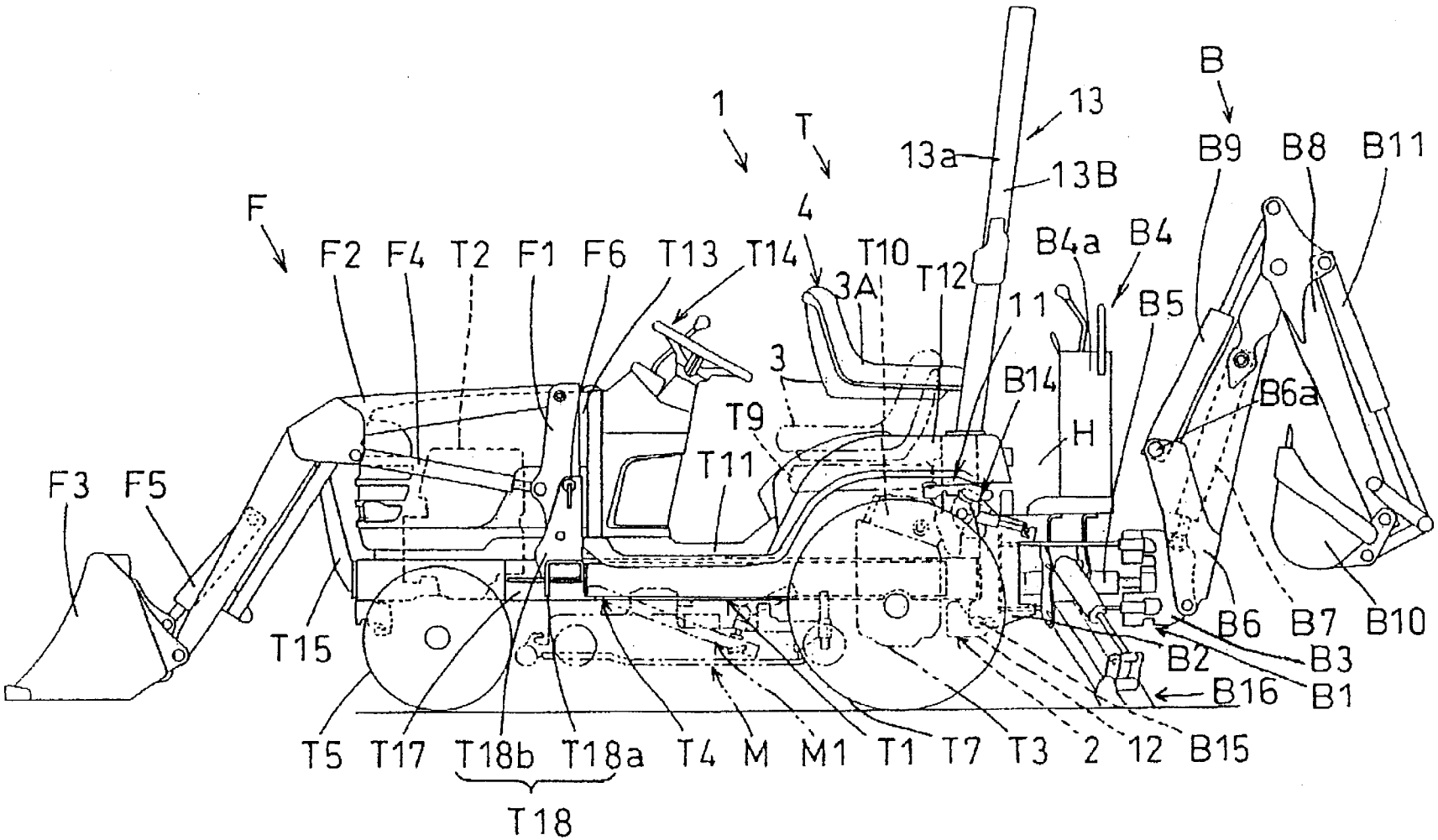
FIG. 1 is a side elevation of a tractor having a backhoe unit according to this invention.
Figure 2:
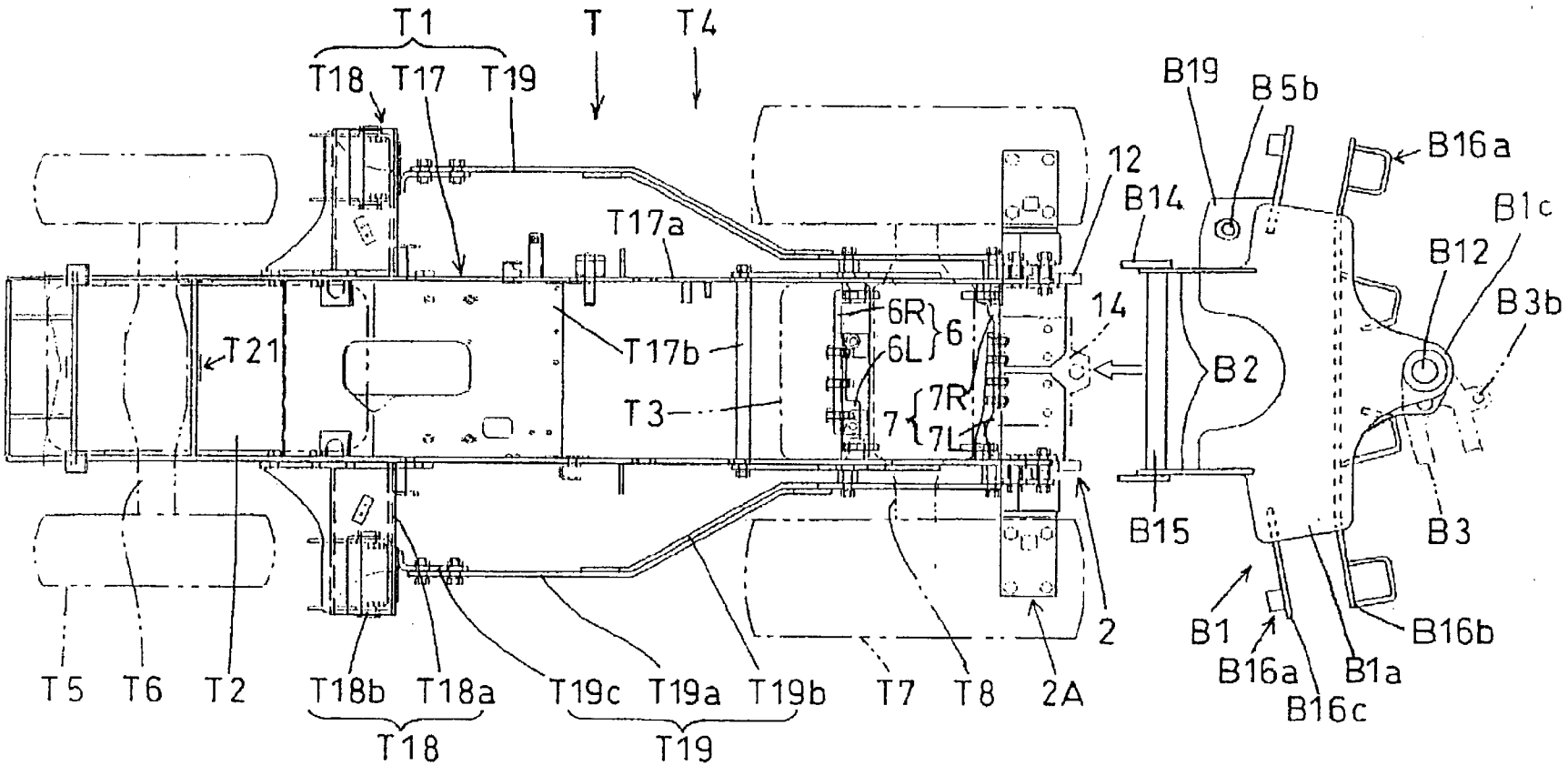
FIG. 2 is a plan view showing a framework of the tractor.
Figure 3:
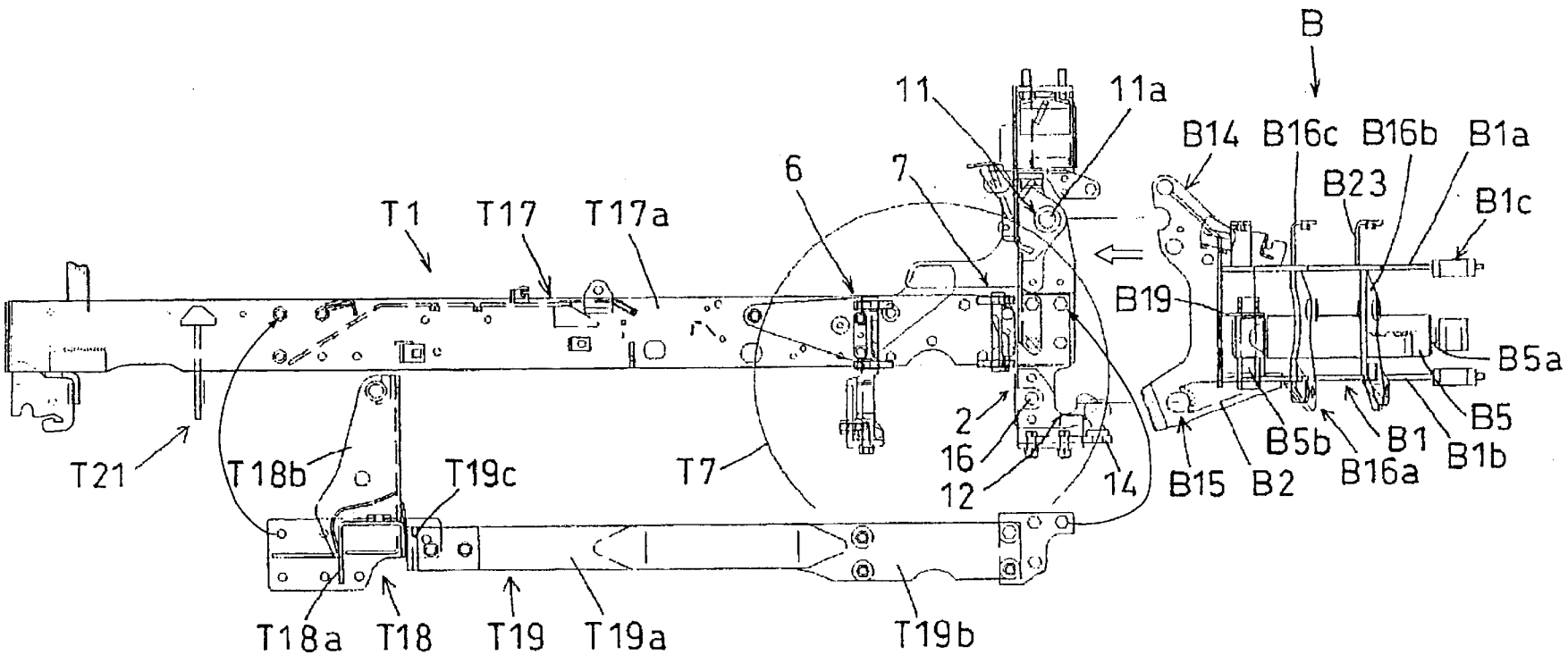
FIG. 3 is a partly exploded side view showing the framework of the tractor.
Figure 4:
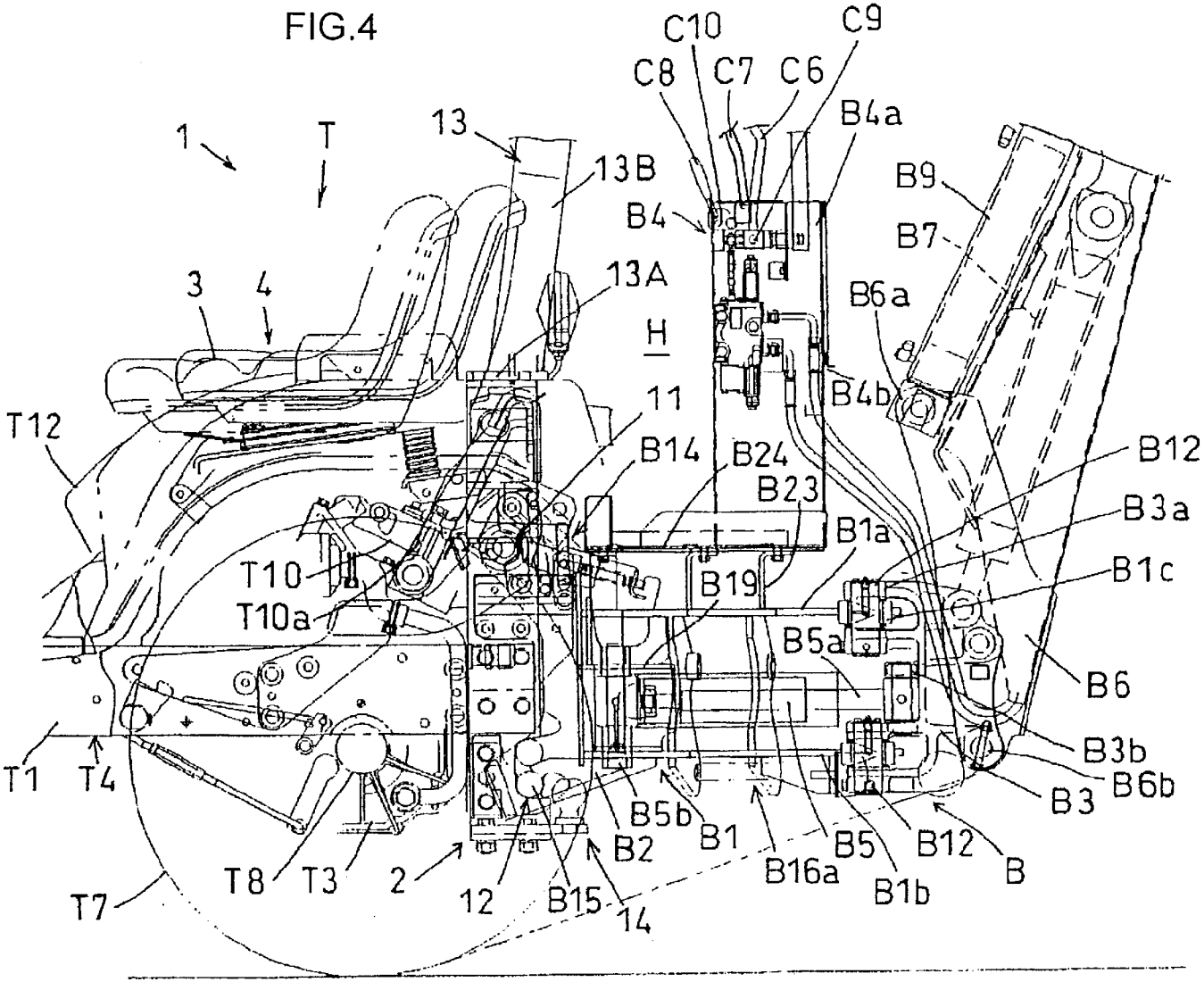
FIG. 4 is a side view of a principal portion showing the rear of the tractor and the backhoe unit.
Figure 5:
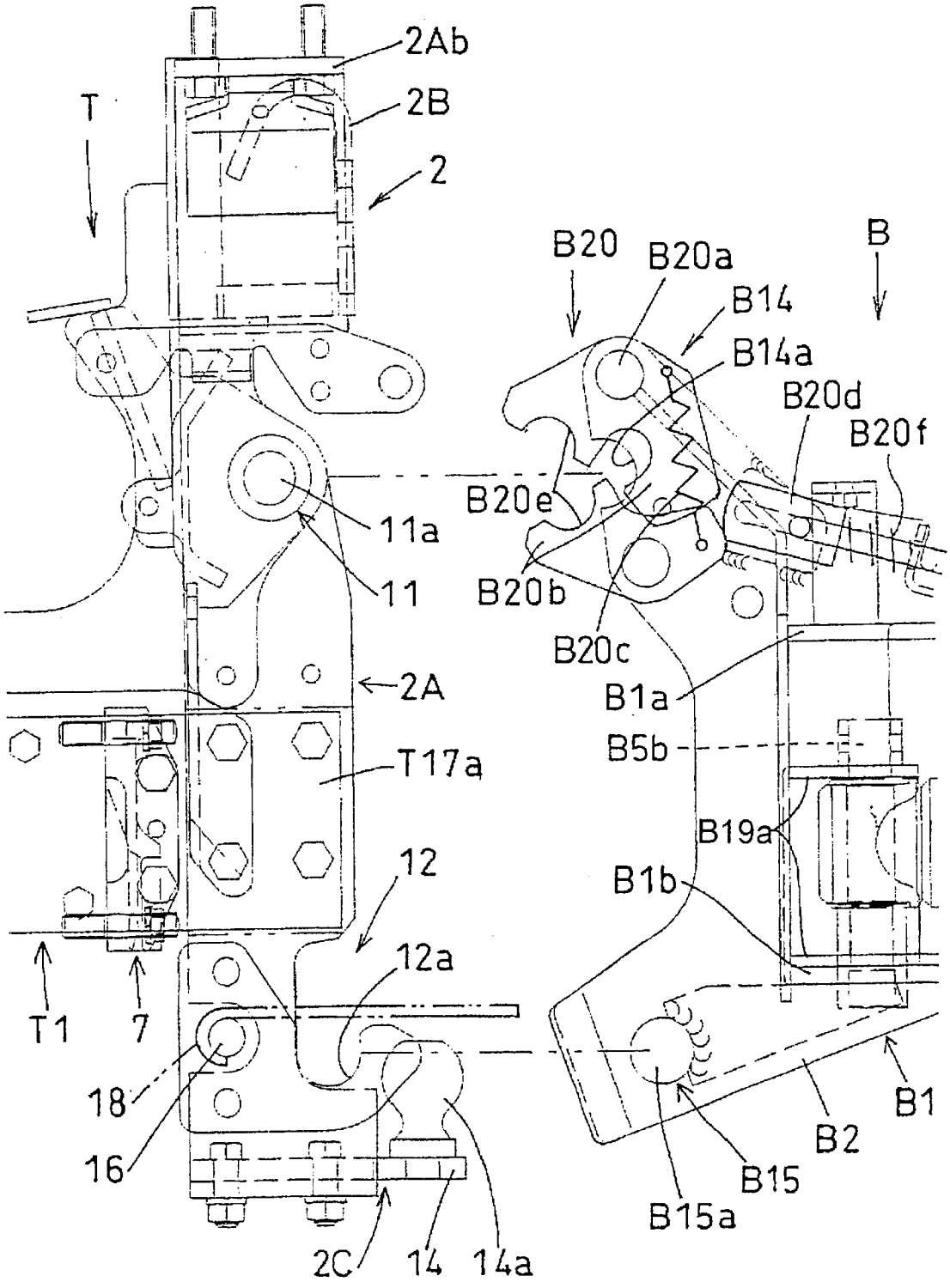
FIG. 5 is a side view with a backhoe mounting frame and the front of the backhoe unit separate
Figure 6:
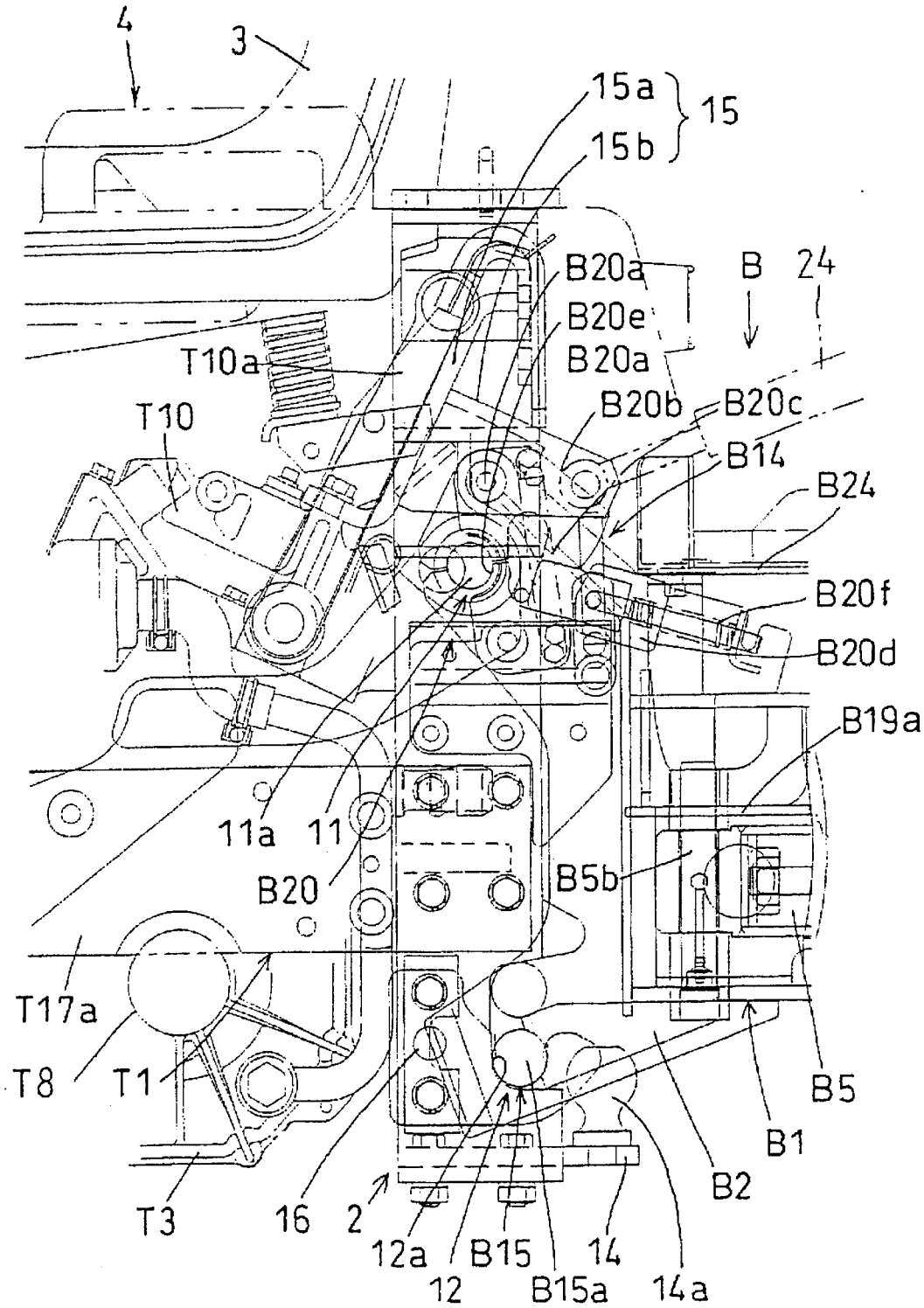
FIG. 6 is a side view of the backhoe mounting frame and the front of the backhoe unit in a disconnected state.

An embodiment of this invention will be described hereinafter with reference to the drawings.

FIGS. 1 through 14 show a tractor-front loader-backhoe (usually abbreviated as TLB) 1. This TLB has a front loader F detachably attached to an intermediate position of a tractor body T to extend forward, and a backhoe unit B detachably attached to the rear of the tractor body T through a backhoe mounting unit 2 to act as a rear working implement. A midmount mower M may be attached under an intermediate portion of the tractor body T.

As shown in FIGS. 1 through 4, the tractor body T includes an elongate vehicle body frame T1 extending in the fore and aft direction, with an engine T2 and a transmission case T3 attached thereto as separated from each other in the fore and aft direction, to constitute a main vehicle body T4. Front wheels T5 are attached to a front axle case T6 supported in a forward position of the vehicle body frame T1. Rear wheels T7 are attached to rear axle cases T8 projecting right and left from the transmission case T3.

A hydraulic device T10 is mounted on the transmission case T3 for raising and lowering the working implement. Above the hydraulic device T10 are a fuel tank T9 and a driver's seat device 4 for reversing a driver's seat 3 between a forward facing position and rearward facing position. A floor seat T11 extends from below the driver's seat 3 to a control portion T14 so as to cover upper areas of the main vehicle body T4 and fuel tank T9. Fenders T12 of the rear wheels T7 are attached by welding or by bolts to right and left sides of the floor seat T11.

T13 denotes a hood for covering the engine T2, and the control portion T14 is disposed rearwardly of the hood T13.

A protector T15 is disposed at the front end of the vehicle body frame T1 for protecting the hood T13.

The vehicle body frame T1, broadly, includes a main frame T17, right and left mast support frames T18, and right and left reinforcing frames T19.

The main frame T17 has an approximately rectangular shape in plan view, including a pair of right and left elongate plates T17*a* directly attached to the engine T2 and transmission case T3 arranged in between, and a plurality of cross members T17*b* formed of rods or plates arranged in the fore and aft direction and interconnecting the right and left elongate plates T17*a*.

The main frame T17 has a support portion T21 in a lower forward position thereof for supporting the front axle case T6 to be pivotable about a center pin. The main frame T17 has also a mounting portion from an intermediate position to a rearward position thereof for vertically movably supporting the midmount mower M.

Each of the right and left mast support frames T18 has a side projecting member T18*a* fixed to and projecting outwardly from a longitudinally intermediate position of the main frame T17, and a mast support member T18*b* erected on an upper surface of an outer end of the projecting member T18*a*. The projecting member T18*a* is attached through a mounting element removably bolted to an outer surface of the main frame T17.

Each of the right and left reinforcing frames T19 has two band plates T19*a* and T19*b* staggered relative to each other in the fore and aft and joined together in intermediate overlapping portions. The forward band plate T19*a* is connected at a forward end thereof to a bracket T19*c* fixed to the side projecting member T18*a*. The rearward band plate T19*b* is connected in a rearward portion thereof to the outer surface of the main frame T17 by connecting elements such as bolts. The rear portion of the rearward band plate T19*b* is opposed to the elongate plates T17*a* with a space in between.

The reinforcing frames T19 substantially overlap the main frame T17 in side view. Thus, a load applied to the mast support members T18*b* may be distributed also to the rear of the main frame T17.

Numerals 6 and 7 denote front and rear mounting devices for interconnecting the right and left elongate plates T17*a*, as do the cross members T17*b*, and adjusting a spacing between the elongate plates T17*a*. The mounting devices 6 and 7 also serve to attach the transmission case T3 to the main frame T17.

The front mounting device 6 has a pair of left and right mounts 6L and 6R which are L-shaped in front view. The vertical portion of each mount 6L or 6R is bolted to an inner surface of the elongate plate T17*a*, and bolted to the transmission case T3. The horizontal portions of the mounts 6L and 6R are connected to each other, with a length of connection fine-adjustable to match the spacing between the right and left elongate plates T17*a*. The lower portions (horizontal portions) of the mounts 6L and 6R project below the main frame T17 to protect a lower front portion of the transmission case T3.

The rear mounting device 7 has a pair of left and right mounts 7L and 7R as does the front mounting device 6. The vertical portion of each mount 7L or 7R is connected to the elongate plate T17*a* and the transmission case T3. The horizontal portions are connected to each other to match the spacing between the right and left elongate plates T17*a*.

The tractor body T has a frame structure, and the backhoe mounting unit 2 is connected to the body frame T1, transmission case T3 and hydraulic device T10. Thus, the tractor body T may be regarded as including the backhoe mounting unit 2.

The front loader F includes right and left masts F1, and a boom F2 vertically pivotably supported at a proximal end thereof by upper ends of the masts F1. The boom F2 supports a bucket F3 at the distal end thereof to be pivotable in scooping and dumping action. The boom F2 is hydraulically driven by a boom cylinder F4. The bucket F3 is hydraulically driven by a bucket cylinder F5.

The masts F1 fit downward into the mast support members T18*b* of mast support frames T18, with the lower ends thereof engaged with the mast support members T18*b*. The masts F1 are locked in intermediate positions thereof by lock pins F6.

When unused, the front loader F may be detached from the mast support frames T18 by pulling out the lock pins F6. When the tractor engages only in backhoe or mowing operations over a long period of time, the vehicle frame T1 may have the right and left mast support frames T18 and reinforcing frames T19 detached from the main frame T17.

The midmount mower M is vertically movably attached to a lower portion of the main vehicle body T4 through a suspending device M1. The mower M has blades rotatable by drive transmitted from the transmission case T3.

When the tractor engages in a loader and/or backhoe operation, the midmount mower M may be detached along with the suspending device M1 from the tractor body T.

Referring to FIGS. 1–4, 7 and 11–14, the backhoe unit B has a pair of right and left connecting jaws B2 arranged at the forward end of a base B1, and a boom bracket B3 is pivotally supported by the rear of the base B1 to be swingable about a vertical swing axis B12. A control column B4 is mounted on the base B1. The base B1 has hydraulically driven outriggers (stabilizers) T16 at the right and left sides thereof.

The boom bracket B3 is horizontally swingable right and left by a single swing cylinder B5. A boom assembly is attached to the boom bracket B3. That is, the boom bracket B3 pivotally supports proximal ends of a boom B6 and a boom cylinder B7, the boom B6 being vertically swingable by the boom cylinder B7. The boom B6 pivotally supports an arm B8 at a distal end thereto to be vertically swingable by an arm cylinder B9. The arm B8 pivotally supports a bucket B10 at distal end thereof swingable by a bucket cylinder B11 to take scooping and dumping action.

The boom B6 is pivotally connected at the proximal end thereof to a lower rear end of the boom bracket B3 through a pin B6*b*, with the boom cylinder B7 mounted in the boom B6. The boom B6 has an intermediate portion projecting upward to define an arm cylinder support B6*a* for pivotally supporting a proximal end of the arm cylinder B9.

When the boom B6 is raised to an uppermost position by the boom cylinder B7, as shown in FIG. 1, the boom B6 assumes a substantially upright posture. In this state, the arm cylinder support B6*a* is located directly over the vertical swing axis B12 and forwardly of the proximal end of the boom B6.

The base B1 has a hollow construction with two flat plates B1*a* and B1*b* vertically spaced from each other and connected together through plates B16*b* and B16*c* constituting attaching mounts T16*a* of the outriggers T16, and the pair of right and left connecting jaws B2. The vertical swing axis B12 is supported by a pair of upper and lower bearings B1*c*, and is vertically divided into two parts arranged coaxially.

Thus, the boom bracket B3 has a forked bearing portion B3*a*. A flange B3*b* projects laterally of a vertically intermediate position of the boom bracket B3 to act as a second cylinder connecting portion for connecting a forward end of a cylinder rod B5*a* of the swing cylinder B5.

A first cylinder connecting portion B19*a* for pivotally connecting a proximal end of the swing cylinder B5 with a pin B5*b* is disposed in one lateral position, e.g. at the right side position in this embodiment, of the base B1, and adjacent and between the mount T16*a* of the right outrigger T16 and the right connecting jaw B2.

That is, the first cylinder connecting portion B19*a* is secured to the plate B16*c* and connecting jaw B2 between the upper and lower flat plates B1*a* and B1*b* constituting the base B1.

The swing cylinder B5 is the clevis type that singly swings the boom bracket B3 through a necessary angle right and left. The swing cylinder B5 provides a swing angle smaller than 90 degrees, and requires only two hydraulic hoses to be connected thereto. The hoses are curved to a limited degree only to require a reduced space therefor.

The swing cylinder B5 has the proximal end thereof disposed in one outer lateral position of the base B1, and the forward end of the cylinder rod B5*a* disposed centrally of the base B1. Thus, the swing cylinder B5 is inclined with respect to the fore and aft direction. Compared with two swing cylinders the trunnion type extending fore and aft and parallel to each other, the swing cylinder B5 may be arranged without being restricted by a middle space transversely of the base B1. On the contrary, the swing cylinder B5 allows for a reduction in the fore and aft dimension of the base B1, to shorten the fore and aft dimension of the backhoe unit B. The backhoe unit B may therefore be close to the tractor body T.

Since the first cylinder mounting portion B19*a* of the swing cylinder B5 is disposed adjacent right or left upper and lower engaging portions B14 and B15, adjacent the mount B16*a* of the outrigger B16, or between the upper and lower engaging portions B14 and B15 and the mount B16*a* of the outrigger B16, the swing cylinder B5 is supported in the strongest position inside the base B1.

Figure 7:
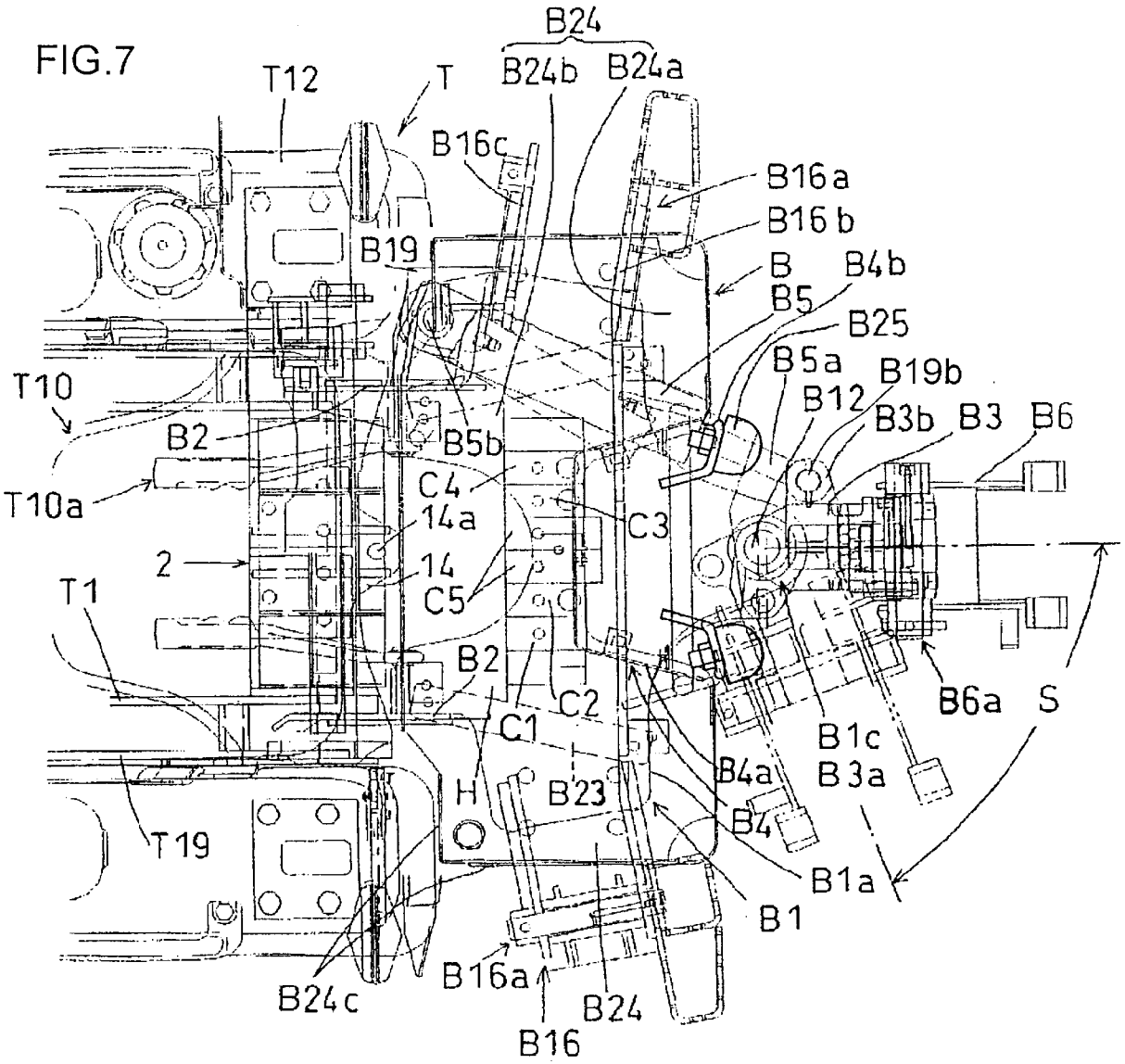
FIG. 7 is a plan view of the backhoe mounting frame and the front of the backhoe unit in a connected state.
Figure 11:
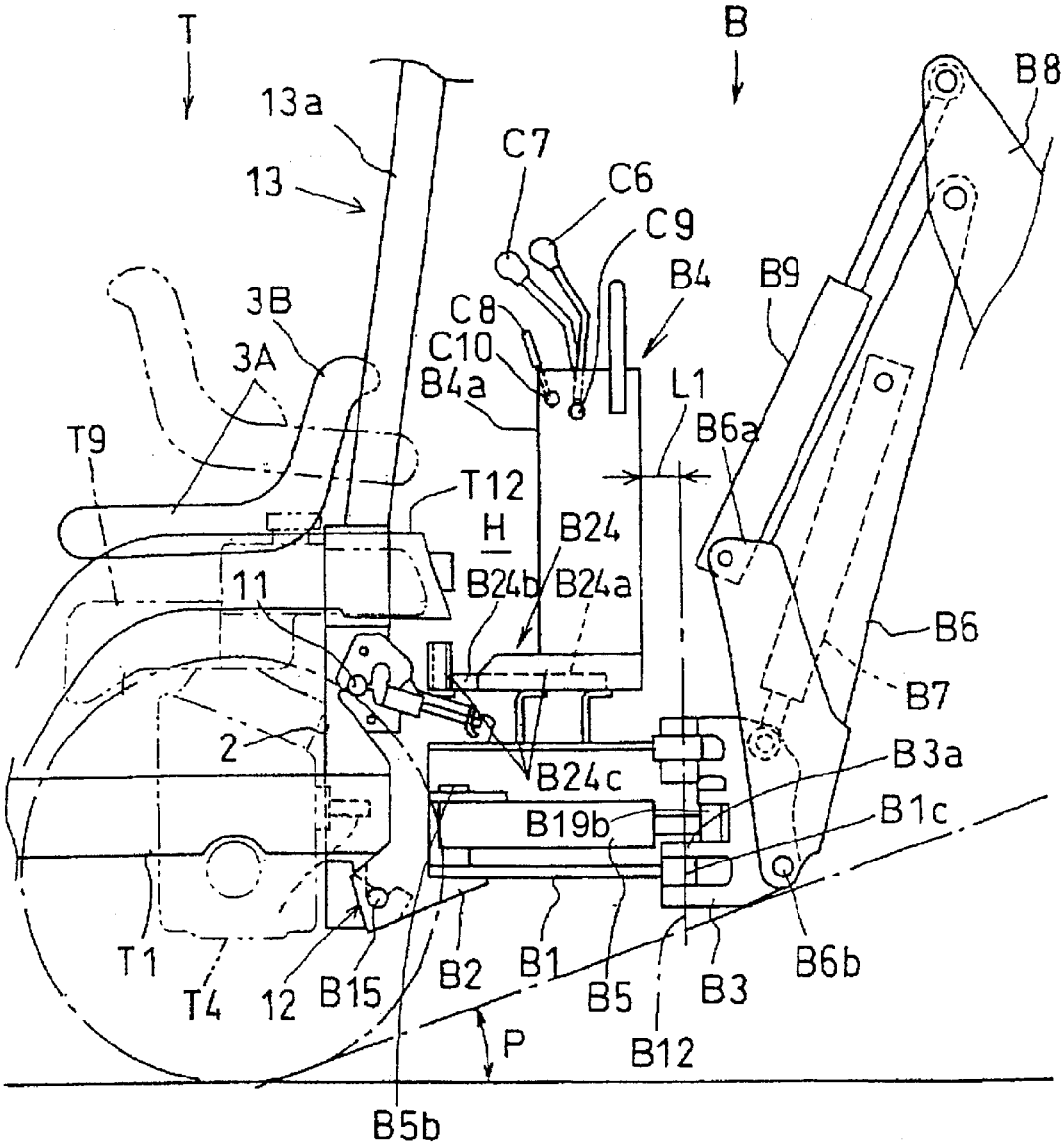
FIG. 11 is a schematic side view showing the rear of the tractor and the backhoe unit.
Figure 12:
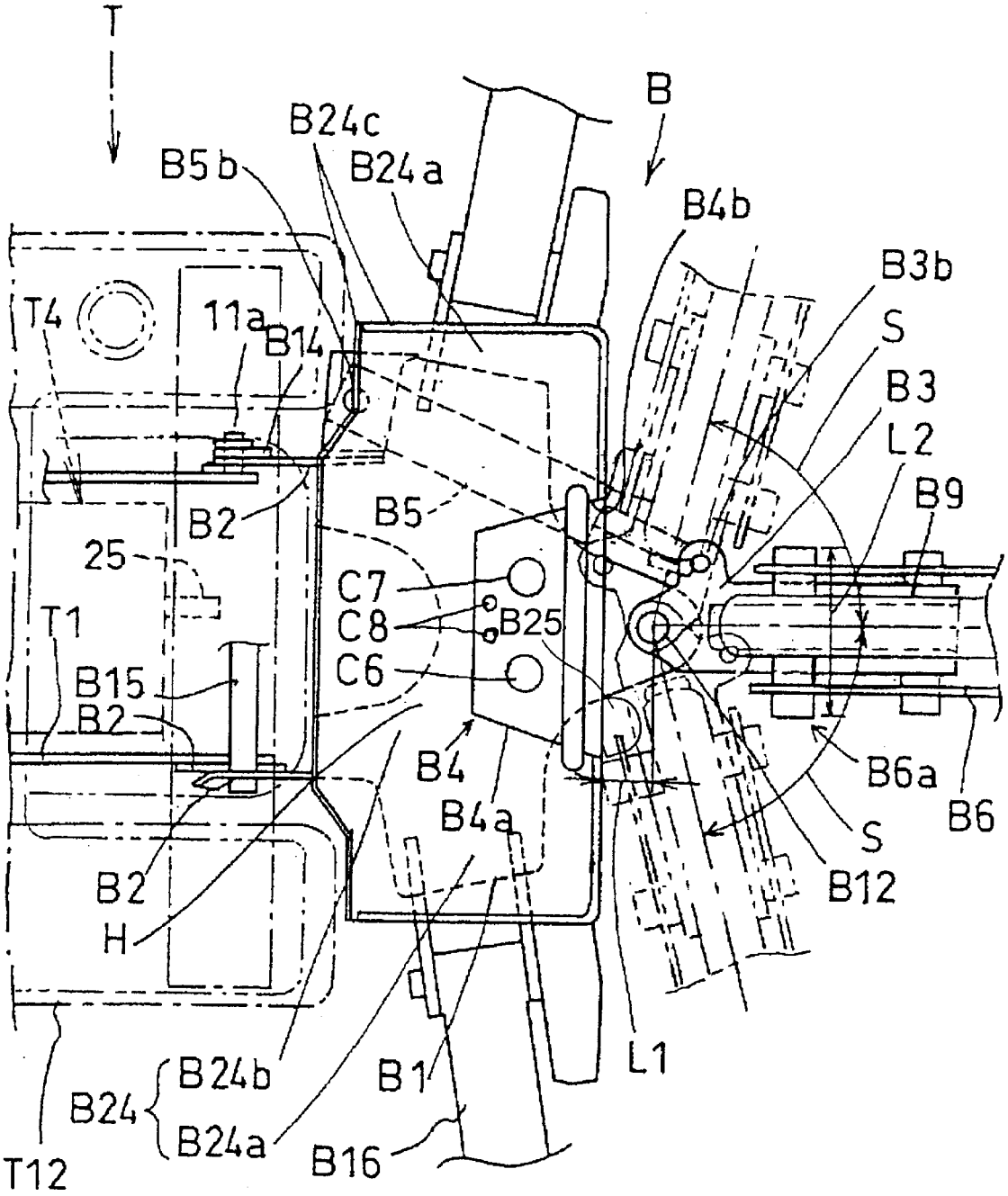
FIG. 12 is a schematic plan view showing the rear of the tractor and the backhoe unit.
Figure 13:
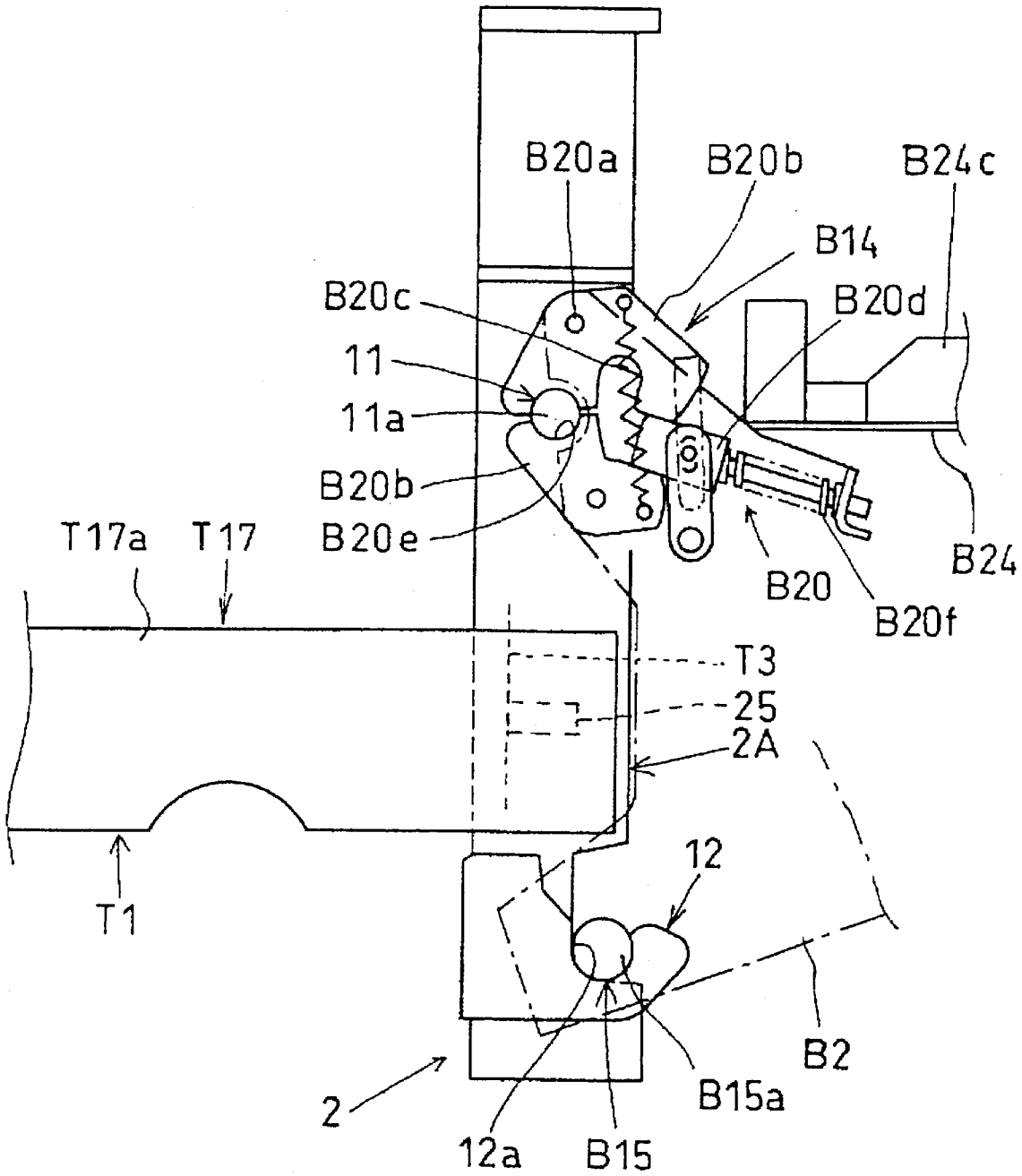
FIG. 13 is a schematic side view showing the backhoe unit and a base frame in a disconnected state.

Referring to FIGS. 4, 7, 11 and 12, the boom bracket B3 is swingable by the single swing cylinder B5 right and left by a maximum swing angle S smaller than 90 degrees from a straight rearward posture (with the boom assembly extending rearward along a centerline of the vehicle body as shown in solid lines in FIGS. 7 and 12).

With the maximum right and left swing angle S of the swing cylinder B5 set smaller than 90 degrees, when the boom B6 is raised by a maximum angle to an uppermost position, a side surface of the arm cylinder support B6*a* which is the foremost portion of the boom B6 does not move to a large extent forwardly of the vertical swing axis B12 (as shown in two-dot chain lines in FIG. 12). Thus, to bring the side surface of the arm cylinder support B6*a* close to the rear of the control column B4, the position of the vertical swing axis B12 may be shifted, by designing, further forward than in the prior art, thereby reducing a fore and aft dimension from the control column B4 to the vertical swing axis B12, and hence the fore and aft length of the backhoe.

The maximum swing angle S, preferably, is in the order of 75 degrees. The control column B4 has a casing B4*a* defining an opening B4*b* in a lower rear portion thereof for permitting entry of the arm cylinder support B6*a* when the boom B6 swings by the maximum angle. The opening B4*b* also provides a passage for hydraulic pipes connected to control valves in the control column B4.

The boom B6 supporting the arm cylinder B9 has bearings projecting from a pair of right and left side plates and supporting a pivot pin of the arm cylinder B9, thereby having a maximum width L2 of considerable size. Where the boom bracket B3 is swingable by 90 degrees about the vertical swing axis B12, the distance L1 from the rear surface of the casing B4*a* of the control column B4 to the vertical swing axis B12 must be greater than a half of the maximum width L2 of the boom B6. However, by setting the maximum swing angle of the boom bracket B3 smaller than 90 degrees as noted above, the bearings of the arm cylinder support B6*a* is further away from the rear surface of the casing B4*a*. The control column B4 may be brought close to the vertical swing axis B12 by a corresponding amount. Thus, the distance L1 is set smaller than a half of the maximum width L2 of the boom B6.

As noted above, the maximum swing angle S of the boom B6 is dependent on the width of the arm cylinder support B6*a* of the boom B6, amount of projection of the bearings, and the presence of the opening B4*b*. The maximum swing angle S may be set to 80–85 degrees or thereabouts by minimizing the width of arm cylinder support B6*a*, minimizing the amount of projection of the bearings, and forming the opening B4*b*.

The fore and aft length of the backhoe may be reduced by placing the vertical swing axis B12 closer to the control column post B4 than in the prior art.

The backhoe mounting unit 2 includes a pair of right and left stoppers B25 in rear positions thereof for contacting the boom bracket B3 swung by the maximum angle S. The stoppers B25 are formed of an elastic material such as rubber for reliably avoiding collision of the swinging boom B6 with the control column B4.

In FIG. 11, angle P represents a bottom-up angle. With this angle, the lower portion of the backhoe unit B does not contact the ground when the main tractor body T is placed on a footplate set to a truck deck for transporting the tractor-front loader-backhoe 1.

Since the bottom-up angle P is substantially fixed, the smaller the distance is from the rear wheels T7 to the rear end of the boom bracket B3, the lower the base B1 and boom bracket B3 may be located. Thus, by reducing the distance L1, the base B1 may be located as low as possible to stabilize the weight balance of the backhoe unit B.

The base B1 has a footrest B24 attached to the upper surface thereof through support ribs B23. The control column B4 is mounted on or alongside the footrest B24. A walkthrough space H is formed on the footrest B24 to extend obliquely rearward from the rear of driver's seat 3 facing rearward. It is to be noted that the fore and aft direction herein is based on the fore and aft direction of the tractor.

The control column B4 contains, in the casing B4*a*, a control valve C1 for controlling the swing cylinder B5, a control valve C2 for controlling the boom cylinder B7, a control valve C3 for controlling the arm cylinder B9, a control valve C4 for controlling the bucket cylinder B11, and control valves C5 for controlling a pair of right and left outrigger cylinders.

These control valves C1–C5 are mounted on an inner surface of a front wall of the casing B4*a* as arranged transversely of the tractor body. A swing and boom control lever C6, an arm and bucket control lever C7 and right and left outrigger control levers C8 are arranged above these valves through pivotal supports C9 and C10. The pivotal supports C9 and C10 of the control levers C6–C8 do not protrude forward from the casing B4*a* to be obstacles in the walkthrough space H.

As shown in FIGS. 7 and 12, the casing B4*a* is trapezoidal, diverging rearward in plan view, with the front surface smaller in width than the rear surface, and the right and left sides inclined rearwardly and outwardly from the front surface. The front surface has dimensions necessary for attaching the control valves C1–C5, while the rear surface has sufficient dimensions for pipe connections, with a minimum fore and aft size.

The footrest B24 is approximately channel-shaped opening rearward in plan view. The footrest B24 includes a pair of right and left foot supports B24*a* diverging rearward for the driver to place his or her feet at opposite sides of the control column B4, and a passage portion B24*b* extending between heel ends of the foot supports B24*a* forwardly of the control column B4 for enabling movement of the driver's feet.

The footrest B24 includes foot stoppers B24*c* erected at front edges, rear edges and right and left side edges, or at least laterally of the front edges, to restrict the driver's feet projecting from the footrest B24.

The front of footrest B24 has right and left sides, as seen in the fore and aft direction, lying adjacent rear ends of the right and left rear wheel fenders T12, and a middle portion projecting forwardly of the rear ends of right and left rear wheel fenders T12. The forward end of this middle portion is in substantially the same position, with respect to the fore and aft direction, as the rear end of a seating portion 3A of driver's seat 3 (3B denoting a backrest at the forward end.

The footrest B24 has an upper surface area determined for securing an adequate accommodating space after an adequate distance is secured from the driver's seat 3 to the control column B4. With the right and left sides of the casing B4*a* inclined rearwardly and outwardly, the driver may comfortably place his or her feet wider apart at the tip than at the heel on the footrest B24. The walkthrough space H may allow movement of the driver despite small fore and aft and sideways distances from the casing B4*a* to the rear ends of right and left rear wheel fenders T12, by increasing the distance from the right and left sides of casing B4*a* to the rear ends of right and left rear wheel fenders T12.

Further, the rear end of the seating portion 3A of driver's seat 3 facing rearward is, with respect to the fore and aft direction, located in substantially the same position as the backhoe mounting unit 2 or rearwardly of the rear end of the tractor body T. This feature also reduces the distance from the tractor body T to the footrest B24, the distance to the control column B4, and the distance to the base B1, thereby reducing the fore and aft length of the backhoe unit B.

The rear end of tractor body T and the forward end of the backhoe mounting unit 2 are adjacent each other in the fore and aft direction. The rear end of the seating portion 3A also is adjacent to the rear end of tractor body T and the forward end of the backhoe mounting unit 2. Thus, the fore and aft dimension from the tractor body T to the control column B4 is reduced to make the base B1 compact in the fore and aft direction.

Each of the right and left connecting jaws B2 of the backhoe unit B has upper and lower engaging portions B14 and B15. The upper and lower engaging portions B14 and B15 are detachably connected to upper and lower couplings 11 and 12 at one side of the backhoe mounting unit 2. Thus, the backhoe unit B may be detachably attached to the tractor body T.

In FIGS. 1 through 14, each upper coupling 11 of the backhoe mounting unit 2 has a pin 11*a*. The upper engaging portion B14 of each connecting jaw B2 has a recess B14*a* opening forward for fitting on the pin 11*a* (while avoiding interference), and a mounting device B20 for gripping the pin 11*a* fitted in the recess B14*a*.

The mounting device B20 includes a pair of upper and lower mount holders B20*b* pivotally supported in upper positions of connecting jaw B2 through upper and lower pins (pivotal supports) B20*a*, a spring B20*c* for biasing the mount holders B20*b* to an open position, and a retaining member B20*d* for retaining the upper and lower holders B20*b* in a closed position. The mount holders B20*b* define grip portions B20*e* for gripping the pin 11*a*.

The retaining member B20*d* includes a rod supported to be slidable fore and aft by a bracket B26 attached to the connecting jaw B2, and a head formed at a forward end of the rod. A spring B20*f* is mounted on the rod between the head and the bracket B26 for constantly biasing the head forwardly.

The connecting jaw B2 pivotably supports a lock release lever B27 defining a slot B28 receiving a pin B29 projecting from the head of the retaining member B20*d*. By pivoting this lock release lever B27 fore and aft, the retaining member B20*d* is moved in the fore and aft direction.

The head of the retaining member B20*d* is movable forward between the pair of mount holders B20*b* when the front ends of the mount holder B20*b* are closed, to maintain this closed state.

The retaining member B20*d* is disposed as inclined rearward and downward so that the rear end of the rod lies in a low position. Thus, the pair of mount holders B20*b* are formed vertically asymmetrical.

The retaining member B20*d* inclined downward may extend under the footrest B24, thereby allowing the footrest B24 to be located close to the tractor body T. As a result, the fore and aft dimension of the base B1 may be reduced.

Each of the upper and lower mount holders B20*b* has a rear end defining a curved surface B30 about the pivotal support B20*a* acting as the center of curvature. When the front ends thereof are opened, the curved surfaces 58 of both mount holders B20*b* simultaneously contact the head of the retaining member B20*d*.

Each lower coupling 12 of the backhoe mounting unit 2 has a recess 12*a* opening upward. The lower engaging portions B15 of the connecting jaws B2 share an elongate rod B15*a* extending transversely of the tractor body. The rod B15*a* placed in the recesses 12*a* from above and supported therein.

Figure 14:
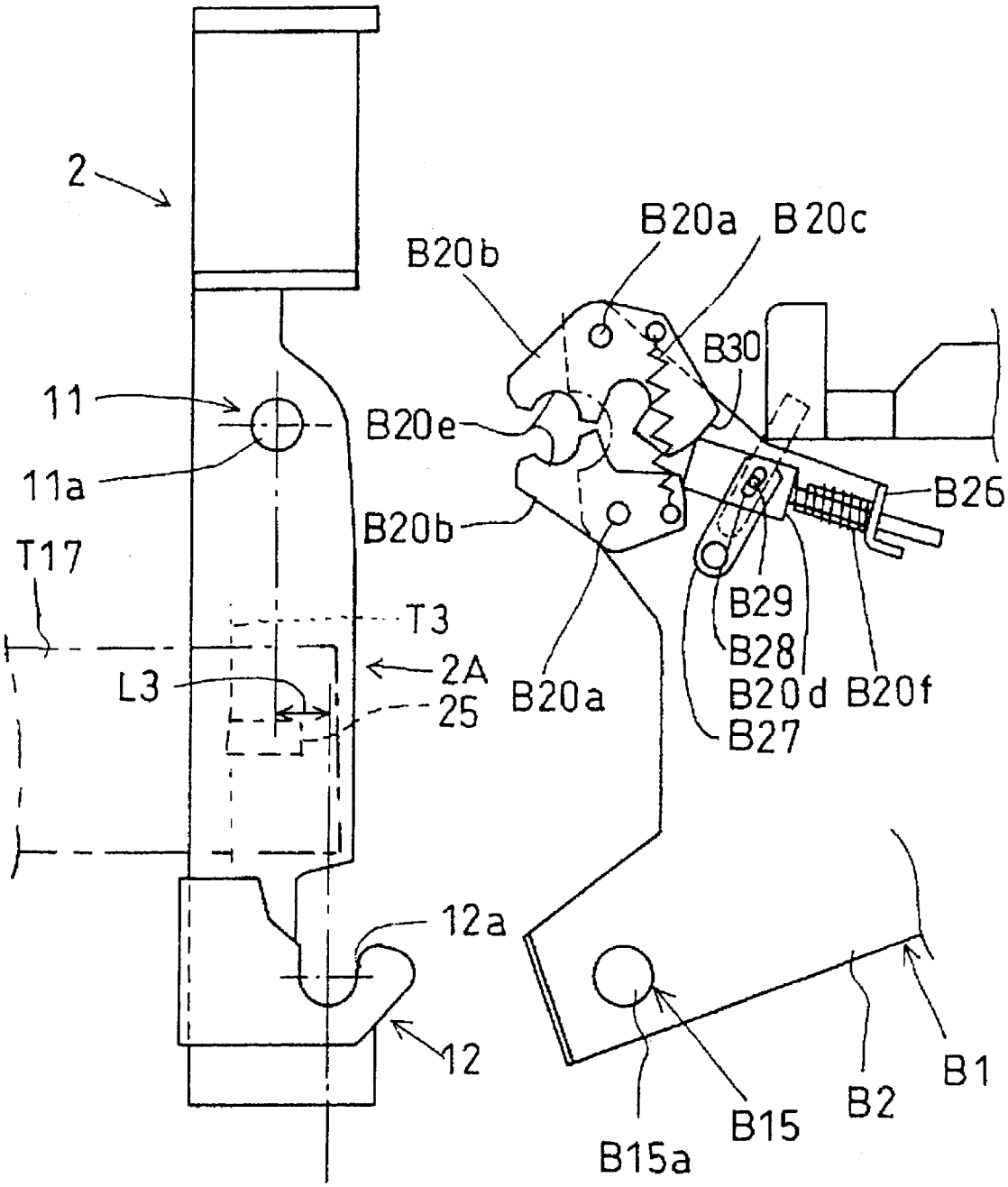
FIG. 14 is a schematic side view showing the backhoe mounting frame and the base of the backhoe unit in a connected state.

In FIG. 14, the upper couplings 11 of backhoe mounting unit 2 may be directly over the lower couplings 12, but are disposed forwardly of the lower coupling 12 by a length L3. This shortens the distance from the tractor body T to the control column B4 to further reduce the fore and aft length of the backhoe unit B.

When attaching the backhoe unit B to the tractor body T, the base B1 is slightly tilted rearward, and the tractor body T is moved to place the recesses 12*a* of the couplings 12 below the rod B15*a* of the lower engaging portion B15 of the connecting jaw B2. Thereafter, the outriggers B16 are operated to place the base B1 in horizontal posture, and the rod B15*a* is inserted into the recesses 12*a*.

As each mounting device B20 approaches the pin 11*a*, with the rod B15*a* resting in the recesses 12*a*, inner parts of the grip portions B20*e* of mount holders B20*b* contact the pin 11*a*. As a result, the upper and lower mount holders B20*b* are closed against the force of spring B20*c*.

When the upper and lower mount holders B20*b* are closed and the grip portions B20*e* fit on the pin 11*a*, the spring B20*f* forces the retaining member B20*d* to enter between the upper and lower mount holders B20*b*. The pin 11*a* is thereby maintained in the gripped state.

Each retaining member B20*d* is biased to the mount holders B20*b* by the spring B20*f*. By removing the retaining member B20*d* from the mount holders B20*b* against the force of spring B20*f*, the mounting device B20 is opened to render the backhoe unit B detachable from the tractor body T.

The backhoe mounting unit 2 is connected in a vertically intermediate position thereof to the main frame T17, and in an upper intermediate position to the hydraulic device T10. A vertical rear frame 13 is mounted on the upper end of the backhoe mounting unit 2. The backhoe mounting unit 2 has a hitch coupling 14 disposed at the lower end thereof. The backhoe mounting unit 2 is detachably attached to the rear end of the vehicle frame T1 and upstanding so as to surround the rear of the transmission case T3.

The backhoe mounting unit 2 not only has the functions to attach the backhoe unit B and vertical rear frame 13, but is constructed to attach, as a rear working implement, a raking device, a box blade device, a rotary plow, a soil packing device or a trailer. One of these devices may be used alone, or in combination with the front loader F and the midmount mower M attached to the tractor body T to carry out varied operations.

Referring to FIGS. 5 through 10, the backhoe mounting unit 2 includes a pair of right and left vertical members 2A, an upper member 2B interconnecting upper positions of the right and left vertical members 2A, and a lower member 2C interconnecting lower positions of the right and left vertical members 2A.

Each of the right and left vertical members 2A is formed of a lower member 2Aa and an upper member 2Ab fixed together. The lower member 2Aa has bent upper portion and lower portion extending horizontally in opposite directions. The upper member 2Ab also has bent upper portion and lower portion extending horizontally in opposite directions.

Figure 15:
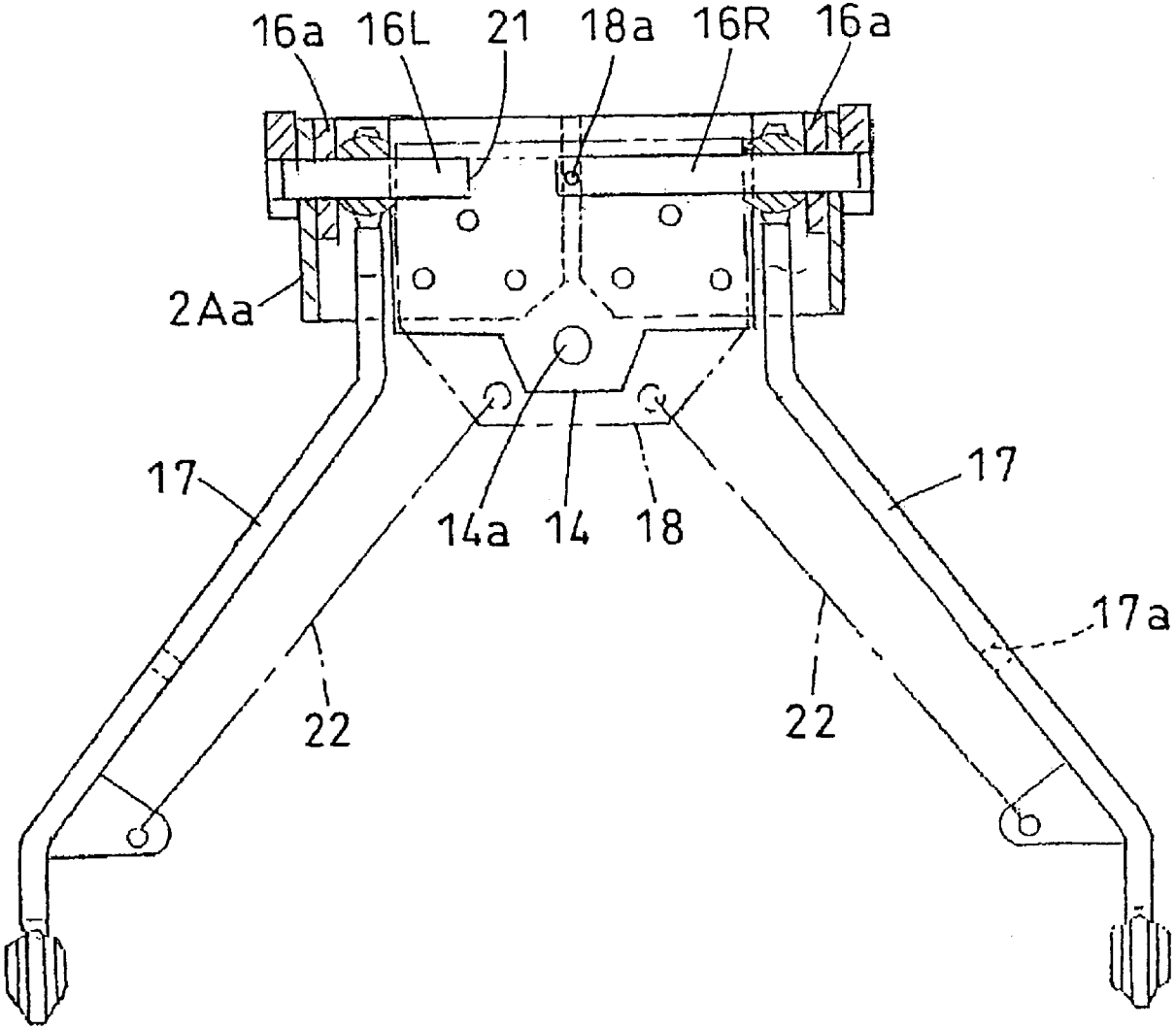
FIG. 15 is a plan view, partly in section, of the lower links connected to a rear coupling frame.
Figure 16:
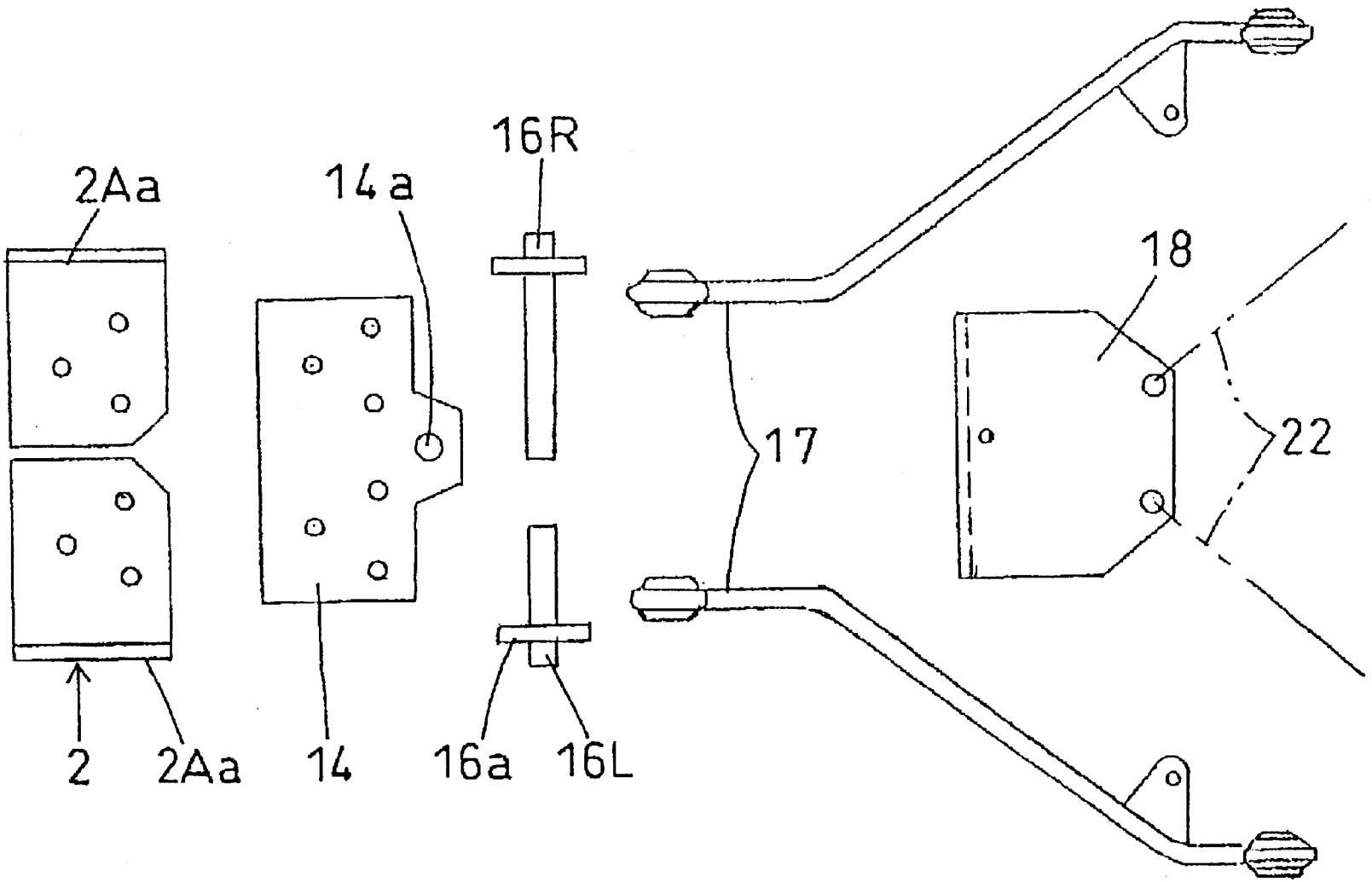
FIG. 16 is an exploded plan view of a lower link connecting structure.

As seen from FIGS. 15 and 16, outer surfaces of the lower members 2Aa of the vertical members 2A have the elongate plates T17*a* of main frame T17 fixed to vertically intermediate positions thereof, components of the upper couplings 11 fixed to upper positions, and components of the lower couplings 12 fixed to lower positions.

The lower member 2C is bolted to lower horizontal portions of the right and left lower members 2Aa. The lower member 2C may be formed simply of plate, but the hitch coupling 14 is used in the embodiment. The hitch coupling 14 has a hitch joint 14*a* providing a hitch connection point for connecting a traction rod of a soil packing device, trailer or the like.

The right and left vertical members 2A have lower link pins 16L and 16R disposed in lower positions thereof. Both lower link pins 16L and 16R have flanges 16*a* welded thereto. These flanges 16*a* are bolted to inner surfaces of the vertical members 2A.

The right and left lower link pins 16L and 16R are inwardly opposed to each other with a spacing 21 therebetween for receiving lower links 17. The right lower link pin 16R (or the left lower link pin 16L) extends to the other side (left side) beyond a middle point transversely of the tractor body T.

Numeral 18 denotes a check chain connector extending over the right and left lower link pins 16 and attached to the right lower link pin 16R by a set pin 18*a* at a substantially middle point transversely of the tractor body T. The check chain connector 18 is attachable and detachable only by inserting and removing the set pin 18*a*.

The check chain connector 18 is used to engage a forward end of a check chain extending between the right and left lower links 17, and to restrict sideways movement of the right and left lower links 17 having forward ends thereof engaged with the right and left lower link pins 16. This dispenses with special lower link retaining members.

That is, a portion of the check chain connector 18 that engages the lower link pins 16 has such a width that substantially fills a space between the right and left lower links 17 engaged with the right and left lower link pins 16. The right and left lower links 17 may be removed from the spacing (gap) 21 only by detaching the check chain connector 18.

The upper member 2B is connected to the upper members 2Ab of the vertical members 2A through brackets. The upper member 2B has a top link bracket 15 secured thereto for pivotally supporting a top link 24 through a pin.

The top link bracket 15 has an attaching portion 15*a* formed of a plate material and defining a link connector 15*b* projecting rearward. The attaching portion 15*a* is fixed in an upper position thereof to the upper member 2B, and bolted at the lower end to the hydraulic device T10.

A lower base plate 13A of the vertical rear frame 13 is bolted to upper horizontal portions of the upper members 2Ab of the vertical members 2A. The vertical rear frame 13 has a main frame body 13B formed of a pipe bent into an inverted U-shape and fixed at opposite lower ends thereof to the lower base plate 13A, and a lower member 13C connected to the opposite lower ends of the main frame body 13B and mounted on the lower base plate 13A.

The lower base plate 13A reinforces the upper portion of the backhoe mounting unit 2, while the upper member 2B reinforces the lower portion of the vertical rear frame 13.

The U-shaped main frame body 13B has right and left props 13*a* erected on the lower base plate 13A. The right and left props 13*a* are wide apart in intermediate to upper portions thereof. Thus, the main frame body 13B bulges laterally outwardly in the intermediate to upper portions thereof. Even where the driver's seat 3 overlaps the vertical rear frame 13 in the fore and aft direction, an accommodating space is secured for the driver seated on the driver's seat 3.

The vertical rear frame 13 includes flex portions 13C formed in intermediate positions of the main frame body 13B. Thus, the vertical rear frame 13 may be bent forward or rearward to reduce the height of the main frame body 13B for storage or other purposes.

Figure 8:
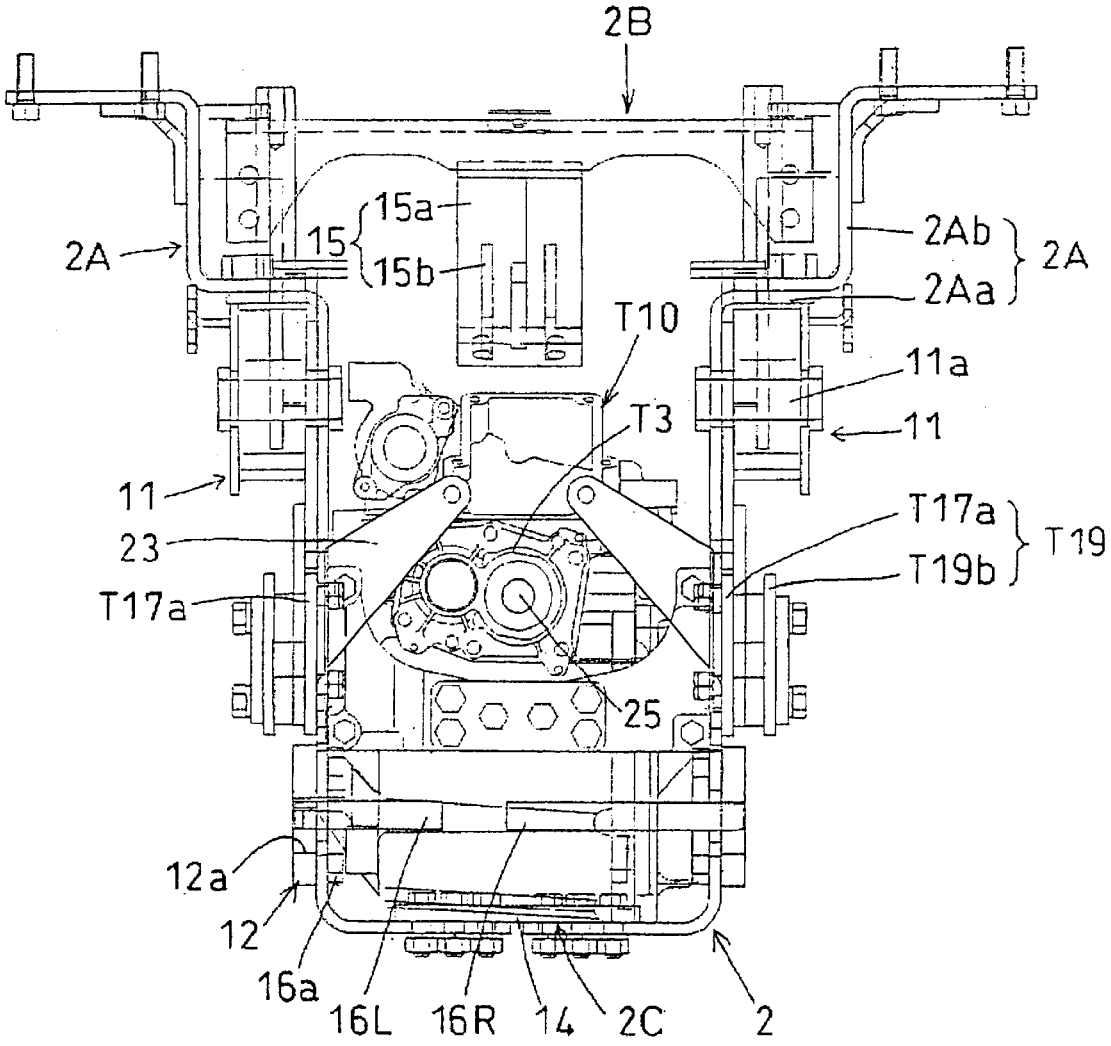
FIG. 8 is a rear view of the tractor with the backhoe mounting frame attached thereto.
Figure 9:
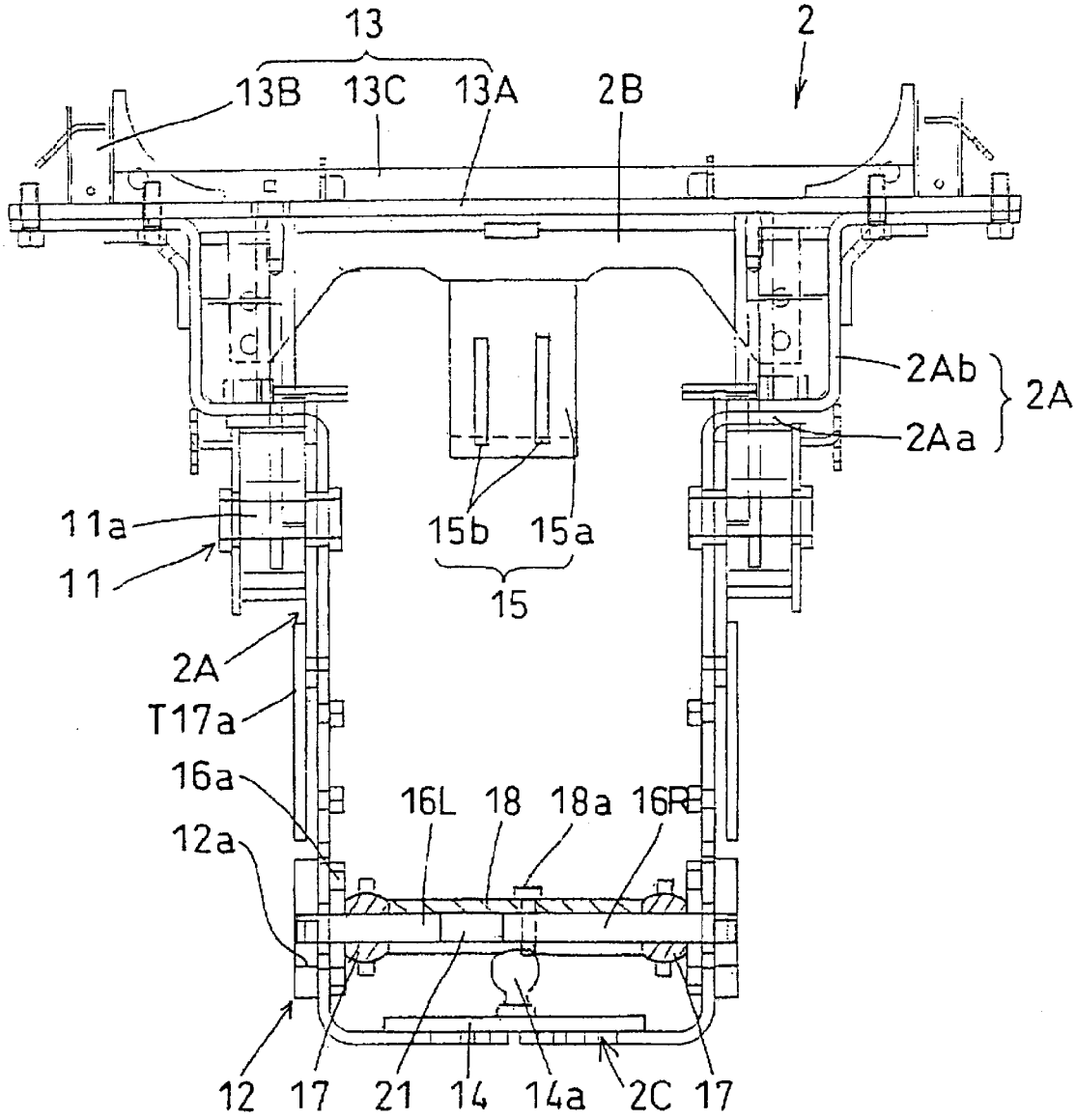
FIG. 9 is a rear view of the backhoe mounting frame.
Figure 10:
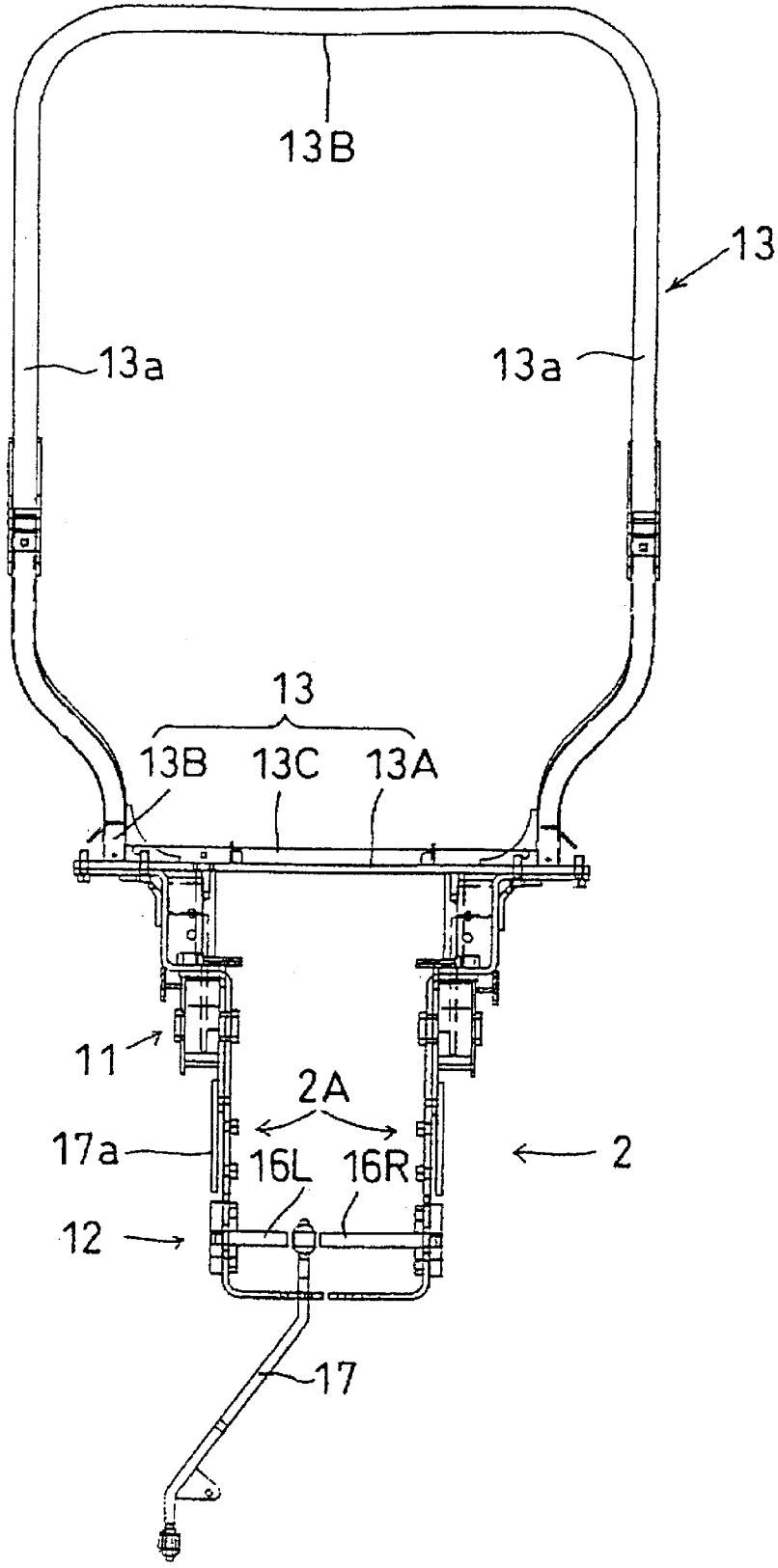
FIG. 10 is a rear view showing a rear vertical frame and lower links connected to the backhoe mounting frame.

As shown in FIG. 8, a pair of right and left attachment reinforcing members 23 interconnect the right and left vertical members 2A and the hydraulic device T10, to improve mounting strength of the backhoe mounting unit 2 attached to the tractor body T.

Numeral 25 is a PTO shaft projecting rearward from the transmission case T3 and overlapping the backhoe mounting unit 2 in the fore and aft direction.

This invention is not limited to the above embodiment, but may be modified in various ways. For example, the first cylinder mounting portion B19*a* of the swing cylinder B5 may be disposed at the left side of the base B1, or adjacent and rearwardly of the mount B16*a* of one outrigger B16.

What is claimed is:

1. A backhoe unit detachably attached to a backhoe mounting frame disposed on a tractor body rearwardly of a driver's seat, comprising:

a base having engaging portions for connection to said backhoe mounting frame;

a driver's footrest and a control column disposed on said base;

a vertical swing axis supported by said base;

a boom bracket supported to be swingable about said vertical swing axis;

a boom assembly attached to said boom bracket; and a single swing cylinder having one end thereof connected to said base through a first cylinder connecting portion, and the other end connected to said boom bracket through a second cylinder connecting portion, to swing said boom bracket horizontally, said swing cylinder disposed in one lateral side of said base to be offset from a centerline of said tractor body and extends slantwise in plan view relative to the centerline.

2. The backhoe unit as defined in claim 1, wherein said engaging portions include a pair of right and left upper engaging portions and a lower engaging portion, said first cylinder connecting portion being disposed in a region substantially between said upper engaging portions and said lower engaging portion.

3. The backhoe unit as defined in claim 1, further comprising swing angle limiting means for limiting a maximum angle of swinging of said boom bracket by said swing cylinder to be less than 90 degrees from a longitudinal axis extending through said vertical swing axis to each of a right side and a left side.

4. A backhoe unit detachably attached to a backhoe mounting frame disposed on a tractor body rearwardly of a driver's seat, comprising:

a base having engaging portions for connection to said backhoe mounting frame;

a driver's footrest and a control column disposed on said base;

a vertical swing axis supported by said base;

a boom bracket supported to be swingable about said vertical swing axis, and;

a boom assembly attached to said boom bracket;

a single swing cylinder having one end thereof connected to said base through a first cylinder connecting portion, and the other end connected to said boom bracket through a second cylinder connecting portion, to swing said boom bracket horizontally, wherein said swing cylinder is disposed in one lateral side of said base to be offset from a centerline of said tractor body and extends slantwise in plan view relative to the centerline; and swing angle limiting means for limiting a maximum angle of swinging of said boom bracket by said swing cylinder to be less than 90 degrees from a longitudinal axis extending through said vertical swing axis to each of a right side and a left side.

5. A The backhoe unit as defined in claim 4, wherein said swing angle limiting means is a pair of right and left stoppers disposed on said backhoe mounting frame for contacting said boom bracket to check the swinging of said boom bracket over the maximum angle.

6. The backhoe unit as defined in claim 4, wherein said control column has a casing defining an opening in a lower rear portion thereof for permitting entry of an arm cylinder support of said boom assembly when said boom assembly swings upward by a maximum angle.

7. The backhoe unit as defined in claim 4, wherein said control column has a casing, a distance from a rear surface of said casing to said vertical swing axis being smaller than a half of a maximum width of said boom assembly.

8. The backhoe unit as defined in claim 4, wherein:

said engaging portions include a pair of right and left upper engaging portions and a lower engaging portion; and each of said upper engaging portions includes:

a pair of upper and lower mount holders vertically pivotably supported by pivotal supports to be forwardly openable and closable for approaching, from behind, an upper coupling attached to said backhoe mounting frame, and removably engaging said upper coupling from radially outward directions, and a retaining member movable, from behind, into a space between said mount holders and rearwardly of said pivotal supports for locking said mount holders against pivotal movement, said upper and lower mount holders being formed asymmetrical and said retaining member being inclined rearward and downward, thereby allowing said retaining member to extend under said footrest.

9. The backhoe unit as defined in claim 4, wherein said boom bracket has a lower end thereof substantially level with said engaging portions.

10. The backhoe unit as defined in claim 4, wherein said footrest includes right and left portions located adjacent rear ends of right and left rear wheel fenders of the tractor, and a middle portion projecting forwardly of said rear ends of said right and left rear wheel fenders.

11. A backhoe unit detachably attached to a backhoe mounting frame disposed on a tractor body rearwardly of a driver's seat, comprising:

a base having engaging portions for connection to said backhoe mounting frame;

a control column disposed on said base;

a vertical swing axis supported by said base;

a boom bracket supported to be swingable about said vertical swing axis;

a boom assembly attached to said boom bracket;

a single swing cylinder having one end thereof connected to said base through a first cylinder connecting portion, and the other end connected to said boom bracket through a second cylinder connecting portion, to swing said boom bracket horizontally; and a driver's footrest disposed on said base, wherein said footrest is approximately channel-shaped opening rearward in plan view, said control column being in a form of a trapezoid having opposed lateral sides diverging rearward in plan view and being disposed in the rearwardly opening portion of said footrest, and the channel-shaped portion of said footrest defines a walk-through space extending obliquely rearward from a rear position of said driver's seat for the driver to climb up and down from said footrest from lateral sides thereof.

12. The backhoe unit as defined in claim 11, wherein said control column has a casing with a front surface thereof smaller in width than a rear surface, and right and left sides inclined rearwardly and outwardly from said front surface.

13. The backhoe unit as defined in claim 11, wherein said footrest includes a pair of right and left foot supports diverging rearward for the driver's feet to be placed at opposite sides of said control column, and a passage portion extending between heel ends of said foot supports forwardly of said control column for enabling movement of the driver's feet.

14. The backhoe unit as defined in claim 11, wherein said footrest includes foot stoppers formed laterally of front edges thereof.

15. The backhoe unit as defined in claim 11, wherein said control column has a casing housing control valves for controlling said cylinder and said boom assembly, said control valves being operable by control levers arranged above said control valves.

16. The backhoe unit as defined in claim 11, wherein said swing cylinder is a single cylinder disposed in one lateral side of said base to be offset from a centerline of said tractor body and extends slantwise in plan view relative to the centerline.

17. The backhoe unit as defined in claim 11, further comprising swing angle limiting means for limiting a maximum angle of swinging of said boom bracket by said swing cylinder to less than 90 degrees from a longitudinal axis extending through said vertical swing axis to each of a right side and a left side.

18. The backhoe unit as defined in claim 17, wherein said swing angle limiting means is in the form of a pair of right and left stoppers disposed on said backhoe mounting frame for contacting said boom bracket to check the swinging of said boom bracket over the maximum angle.

* * * * *

UNITED STATES PATENT AND TRADEMARK OFFICE

CERTIFICATE OF CORRECTION

PATENT NO. : 6,637,136 B2
DATED : October 28, 2003
INVENTOR(S) : Tuyoshi Aoki et al.

It is certified that error appears in the above-identified patent and that said Letters Patent is hereby corrected as shown below:

Title page,
Item [73], Assignee, "Kuboto" should read -- Kubota --.

Column 13,
Line 40, delete ", and".

Signed and Sealed this

Ninth Day of March, 2004

JON W. DUDAS
*Acting Director of the United States Patent and Trademark Office*